US008608458B2

(12) United States Patent
Jensen et al.

(10) Patent No.: US 8,608,458 B2
(45) Date of Patent: Dec. 17, 2013

(54) PUMP ASSEMBLY

(75) Inventors: Jens Solvstrom Jensen, Randers Sv (DK); Kim Hulegaard Jensen, Rodkaersbro (DK); Steen Mikkelsen, Bjerringbro (DK)

(73) Assignee: Grundfos Management a/s, Bjerringbro (DK)

( * ) Notice: Subject to any disclaimer, the term of this patent is extended or adjusted under 35 U.S.C. 154(b) by 182 days.

(21) Appl. No.: 13/144,318

(22) PCT Filed: Feb. 2, 2010

(86) PCT No.: PCT/EP2010/000604

§ 371 (c)(1),
(2), (4) Date: Jul. 13, 2011

(87) PCT Pub. No.: WO2010/097158

PCT Pub. Date: Sep. 2, 2010

(65) Prior Publication Data

US 2011/0268589 A1 Nov. 3, 2011

(30) Foreign Application Priority Data

Feb. 26, 2009 (EP) ..... 09002715

(51) Int. Cl.
*F04B 39/06* (2006.01)
*H02K 9/04* (2006.01)

(52) U.S. Cl.
USPC ..... 417/370; 417/372; 310/59

(58) Field of Classification Search
USPC ..... 417/357, 366, 369, 370, 371, 372; 310/54, 58, 59, 62, 63, 64; 415/110, 415/111, 115, 175, 176
See application file for complete search history.

(56) References Cited

U.S. PATENT DOCUMENTS

| | | | | | |
|---|---|---|---|---|---|
| 2,763,214 | A | * | 9/1956 | White | 417/357 |
| 2,993,449 | A | * | 7/1961 | Harland | 417/357 |
| 3,135,213 | A | * | 6/1964 | Smith et al. | 417/368 |
| 3,220,349 | A | * | 11/1965 | White | 417/357 |
| 3,220,350 | A | * | 11/1965 | White | 417/357 |
| 3,225,698 | A | * | 12/1965 | Spisiak | 417/369 |
| 3,371,613 | A | * | 3/1968 | Dahlgren et al. | 417/368 |

(Continued)

FOREIGN PATENT DOCUMENTS

| | | | |
|---|---|---|---|
| CA | 488444 | A | 11/1952 |
| GB | 2330014 | A | 4/1999 |

OTHER PUBLICATIONS

Int'l Search Report issued on May 3, 2010 in Int'l Application No. PCT/EP2010/000604.

*Primary Examiner* — Devon Kramer
*Assistant Examiner* — Nathan Zollinger
(74) *Attorney, Agent, or Firm* — Panitch Schwarze Belisario & Nadel LLP

(57) ABSTRACT

A pump assembly includes a pump housing (2) with a fluid entry (6) and a fluid exit (8) for a fluid to be delivered. A stator housing (4) is connected to the pump housing (2). At least one cooling channel (12) is formed in a wall of the stator housing (4) and is connected to cooling channels (22, 24) in the pump housing (2), which are in connection with the fluid entry (6) and the fluid exit (8), so that the fluid flows through the at least one cooling channel on account of the pressure difference between the fluid entry (6) and the fluid exit (8).

8 Claims, 4 Drawing Sheets

(56) References Cited

U.S. PATENT DOCUMENTS

| | | | | | |
|---|---|---|---|---|---|
| 3,395,644 | A | * | 8/1968 | Grebel et al. | 417/357 |
| 4,013,384 | A | * | 3/1977 | Oikawa | 417/368 |
| 4,047,847 | A | | 9/1977 | Oikawa | |
| 5,009,578 | A | * | 4/1991 | Hyland | 417/365 |
| 5,129,795 | A | * | 7/1992 | Hyland | 417/423.12 |
| 5,143,515 | A | * | 9/1992 | Boster et al. | 415/179 |
| 5,246,349 | A | * | 9/1993 | Hartog | 417/371 |
| 5,248,245 | A | * | 9/1993 | Behnke et al. | 417/366 |
| 5,281,088 | A | * | 1/1994 | Brandt | 415/171.1 |
| 5,322,421 | A | * | 6/1994 | Hansen | 417/420 |
| 5,641,275 | A | * | 6/1997 | Klein et al. | 417/420 |
| 5,949,171 | A | * | 9/1999 | Horski et al. | 310/216.105 |
| 5,997,261 | A | * | 12/1999 | Kershaw et al. | 417/366 |
| 5,997,264 | A | | 12/1999 | Klein et al. | |
| 6,126,416 | A | * | 10/2000 | Lee | 417/423.3 |
| 6,254,361 | B1 | * | 7/2001 | Sabini | 417/423.14 |
| 6,293,769 | B1 | * | 9/2001 | Radermacher et al. | 417/357 |
| 6,488,480 | B1 | * | 12/2002 | Zhong | 417/310 |
| 6,692,225 | B2 | * | 2/2004 | Lin | 415/72 |
| 6,722,854 | B2 | * | 4/2004 | Forsberg | 417/63 |
| 6,814,549 | B2 | * | 11/2004 | Kimberlin et al. | 417/357 |
| 6,884,043 | B2 | * | 4/2005 | Kimberlin et al. | 417/355 |
| 7,331,773 | B2 | * | 2/2008 | Nawa | 417/440 |
| 7,334,543 | B2 | * | 2/2008 | Pawellek | 123/41.1 |
| 7,575,421 | B2 | * | 8/2009 | McAuliffe et al. | 417/366 |
| 2006/0113851 | A1 | * | 6/2006 | Ishihara et al. | 310/52 |
| 2007/0278869 | A1 | * | 12/2007 | Taketsuna | 310/54 |

* cited by examiner

PUMP ASSEMBLY

CROSS-REFERENCE TO RELATED APPLICATIONS

This application is a Section 371 of International Application No. PCT/EP2010/000604, filed Feb. 2, 2010, which was published in the German language on Sep. 2, 2010, under International Publication No. WO 2010/097158 A1 and the disclosure of which is incorporated herein by reference.

BACKGROUND OF THE INVENTION

The present invention relates generally to a pump assembly with a pump housing and a stator housing.

Electrically operated pump assemblies usually include a pump housing and a stator housing, which is applied thereon, wherein at least one pump impeller is arranged in the pump housing, and the stator and the rotor of the electric motor are arranged in the stator housing. Moreover, with modern pump assemblies, electronic components for control of the drive motor are often arranged in or on the stator housing. These in particular may be the power electronics of a frequency converter for rotational speed control of the pump assembly. These electronic components produce waste heat, so that a cooling is necessary as the case may be. This may be effected alone by way of the surrounding air by way of cooling bodies. Moreover, it is, however, also known to provide a liquid cooling, wherein the fluid may be the fluid to be delivered by the pump assembly, in particular water. For this, after assembly of the stator on the pump housing, additional cooling conduits must be connected between the stator and the pump housing. This demands an increased assembly effort. Moreover, it is not so easy to fasten the stator housing at different angular positions on the pump housing, which may be necessary depending on the installation position, in order to bring electrical connections and display elements on the stator housing into the desired accessible position.

With regard to these problems, it is an objective of the present invention to create an improved pump assembly, which on the one hand permits a good cooling of electronic components on or in the stator housing and furthermore is simple to assemble.

BRIEF SUMMARY OF THE INVENTION

The above objective is achieved by a pump assembly having a pump housing, a fluid entry and a fluid exit for a fluid to be delivered, as well with as a stator housing which is connected to the pump housing, wherein at least one cooling channel is formed in a wall of the stator housing, and is connected to cooling channels in the pump housing, which are in connection with the fluid entry and the fluid exit, so that the fluid flows through the at least one cooling channel on account of a pressure difference between the fluid entry and the fluid exit. Preferred embodiments are to be deduced from the subsequent description as well as the attached drawings.

The pump assembly according to a preferred embodiment of the present invention includes a pump housing which includes a fluid entry and a fluid exit for a fluid to be delivered, for example water. At least one impeller of the pump which delivers the fluid, is arranged between the fluid entry and the fluid exit in this pump housing. A stator housing, in which an electrical drive, i.e., in particular stator and rotor of an electric motor are arranged, is connected to the pump housing. The rotor of the electric motor is connected to the impeller of the pump in the known manner. Moreover, electronic components may be arranged in or on the stator housing. Thus, for example, a terminal box may be applied onto the outer wall of the stator housing, which contains electrical connections, display elements and/or electronic components for the control, in particular the speed control of the electric motor of the pump assembly.

According to a preferred embodiment of the present invention, at least one cooling channel is formed on at least a wall of the stator housing and is connected to cooling channels in the pump housing, which are in connection with the fluid entry and the fluid exit. On operation of the pump, i.e., when the impeller of the pump delivers fluid, a pressure difference prevails between the fluid entry and fluid exit. This leads to the fluid flowing to the fluid entry from the fluid exit through the described fluid channels. A fluid flow of the fluid to be delivered is produced in the cooling channels in this manner, which may be applied on or in the stator housing for cooling electrical or electronic components. According to a preferred embodiment of the present invention, thereby the at least one cooling channel is formed in the stator housing in the wall of the stator housing. For example, the stator housing may be cast of metal or plastic, and thereby a suitable channel may be formed in the wall. Moreover, it is also possible to form such a channel in the wall by way of subsequent machining, or to compose the stator housing of several parts, so that such a cooling channel is formed between these parts in the wall. Components to be cooled are preferably brought into heat-conducting connection with this wall, so that the heat of these components may be transmitted onto the wall and in the wall may be led away by the fluid flowing through the cooling channel in the wall. An optimal cooling of electronic or electrical components on the stator housing may be achieved in this manner. The motor itself in the stator housing may also be cooled in this manner. Preferably, the cooling channels are also designed in the pump housing in the wall of the pump housing itself, as is described above on the occasion of the stator housing, for example on casting the pump housing of metal or plastic. The additional assembly of cooling conduits or flexible tubings may be done away with on account of the fact that the at least one cooling channel of the stator housing and preferably also the cooling channels in the pump housing are designed in the wall of the pump housing itself, so that the assembly of the pump assembly is simplified as a whole. The at least one cooling channel of the stator housing is in connection with the cooling channels in the pump housing on a bearing surface between the stator housing and the pump housing, wherein preferably a seal is provided on or in the bearing surface, in order to seal the cooling channels to the outside. The at least one cooling channel in the stator housing thereby runs preferably such that it includes two openings facing the pump housing, an entry opening and an exit opening, which in each case are connected to a cooling channel in the pump housing. Thereby, a cooling channel in the pump housing leads to the fluid exit and thus connects this to the entry of the cooling channel in the stator housing. The other cooling channel leads from the exit of the cooling channel in the stator housing to the fluid entry in the pump housing. Also, it is to be understood that several such cooling channels may be designed in the stator housing, which accordingly are connected to two or more cooling channels in the pump housing. The cooling channel or cooling channels in the stator housing may be wound or run in a meandering manner, in the wall of the stator housing, preferably the peripheral wall, in order to cool a larger surface Preferably, with regard to the stator housing and the pump housing, one includes a first flange and one a second flange, via which the pump housing and the stator housing are connected to one another. This connection may be effected in the known manner for example via screw bolts. The cooling channels of the pump housing and the at least one cooling channel of the stator housing thereby run in each case into connection openings in the associated flange, and the connection openings in the two flanges lie opposite one another, in a manner such that the cooling channels of the stator housing and pump housing are connected to one another. This means that openings of the cooling channels are formed in the flanges, which lie opposite one another and which are preferably sealed to the surrounding flange surface by seals.

Further preferably, at least two connection openings are provided in the first or the second flange, which are connected to the same end of an adjacent cooling channel, and which are arranged in the flange at different angular positions, in a manner such that the stator housing may be connected to the pump housing in at least two different angular positions, in which in each case at least one connection opening of the first and of the second flange lie opposite one another. Thus, for example, a cooling channel which is connected to the fluid exit of the pump, may end on the flange of the pump housing in two connection openings, which are distanced to one another in the peripheral direction, in the pump housing. The at least one cooling channel of the stator housing comprises only one connection opening, which is situated in the flange of the stator housing. Depending on the angular position in which the stator housing is then applied to the pump housing, the connection opening of the cooling channel in the stator housing comes to overlap with another of the two connection openings in the flange of the pump housing. The second connection opening in the pump housing is then covered by the flange of the stator housing and suitably closed. Thereby, it is to be understood that a seal is arranged between the two flanges for sealing, which then also closes the connection opening which is not used, in a sealing manner. A second cooling channel in the pump housing, which is connected to the fluid entry, and forms a connection to a second connection opening of the at least one cooling channel in the stator housing, may accordingly run out in two connection openings in the flange of the pump housing. Moreover, it is to be understood that more than two connection openings for each cooling channel may be provided in the flange of the pump housing. Alternatively, it would also be possible in each case to provide only one connection opening for the cooling channels in the pump housing, and to let the cooling channel in the stator housing run with its ends into in each case several connection openings which are distanced to one another in the peripheral direction. With this converse design, it would also be possible to bring the pump housing and the stator housing into different angular positions to one another, wherein the cooling channels of the pump housing and the stator housing would automatically connect to one another.

Preferably, at least one cooling channel which extends in an arched manner in the peripheral direction of the flange and in which several connection openings which are distanced to one another in the peripheral direction are formed, is formed in at least one of the two flanges. Such an arched cooling channel extends preferably parallel to the bearing surface of the flange in its peripheral direction and is open towards the bearing surface of the flange through the individual connection openings. This means that the arched channel connects the individual connection openings to the connecting cooling channel or cooling channels. Such an arched cooling channel is formed in the associated flange of the respective housing part, depending on whether several connection openings for a cooling channel are provided in the stator or in the pump housing.

Further preferably, two cooling channels which extend in an arched manner along an angle of 180° in the peripheral direction of the flange, are formed in one of the two flanges, of which one serves for the fluid supply and the other the fluid discharge, and in which in each case several connection openings distanced to one another in the peripheral direction of the flange are formed. The arched cooling channels thus in each case extend essentially over a semicircle of the flange. For example, two such arched cooling channels are arranged in the flange of the pump housing, wherein one is connected to the fluid entry and one to the fluid exit of the pump housing via a cooling channel. Thus, the connection openings which create the connection to the fluid entry are arranged in one half of the flange of the pump housing, and the connection openings which create the connection to the fluid exit, are arranged in the other half. With this design, the connection openings are arranged in the oppositely lying flange, i.e., with this example of the stator housing, are preferably arranged lying diametrically opposite, so that the one connection opening comes to overlap with the one half of the flange of the pump assembly and the other connection opening with the other half of the flange of the pump assembly, and in each case come to overlap there with a connection opening. Alternatively, the design may also be the other way round, i.e., accordingly the two arched cooling channels extending over 180° are formed in the flange of the stator housing and two oppositely lying, individual connection openings are arranged in the flange of the pump housing.

Further preferably, the at least two connection openings which are distanced to one another, are distanced to one another in the peripheral direction of the flange by an angle which corresponds to the angle between two fastening bolts for the connection of the two flanges. Fastening bolts are provided for connecting the two flanges. These may either be firmly attached to one of the flanges, or alternatively one may also form through-holes in the two flanges, through which fastening bolts, in particular fastening screws, may be inserted. By way of the fact that the angular distance between the connection openings of the cooling channels corresponds to the angular distance between the two fastening bolts or accordingly two through-holes for the fastening bolts, the distribution of the connection bolts over the periphery of the flange has the same angular division as the arrangement of the fastening bolts or the holes for the fastening bolts. By way of this, one succeeds in suitable connection openings in the flange of the pump housing overlapping with the connection openings in the flange of the stator housing, in every possible angular position, in which the pumps and the stator housing may be connected to one another on account of the arrangement of the fastening. As described, at least one pair of connection openings is formed preferably in each flange, of which one connection opening serves for the fluid supply and the other for the fluid discharge. In the case that a cooling channel which in each case ends with one end in a connection opening, is formed in the stator housing, one of these connection openings serves for the fluid entry or the fluid supply, and the other for the fluid exit or the fluid discharge out of this cooling channel. Accordingly, an arrangement of at least two connection openings is provided in the pump housing, of which one is connected to the fluid exit of the pump housing. This connection opening serves for the fluid supply to the cooling channel in the stator housing, since a higher pressure prevails at the fluid exit of the pump housing. The second connection opening in the pump housing is connected to the fluid entry of the pump housing and serves for the fluid discharge out of the cooling channel of the stator housing.

As already described above, it is preferable for the two connection openings of a pair of connection openings to be distanced to one another in the peripheral direction of the flange by 180°. Preferably, only two connection openings are provided in the stator housing, an entry opening and an exit opening to the cooling channel in the stator housing. These connection openings are preferably arranged in a diametrical manner, i.e., distanced by 180° on the flange of the stator housing. Then, preferably at least two connection opening are provided on the flange of the pump housing, which are distanced by 180° and of which one is connected to the fluid entry and one to the fluid exit. Further preferably, in each case several connection openings are provided in the pump housing, which are arranged in arched cooling channels, as described above. Thereby, the connection openings in the two arched cooling channels are preferably distributed such that one connection opening always lies in the one cooling channel, and one connection channel in the other cooling channel, lying diametrically opposite one another. It is to be understood that the arrangement may also be the other way round, that the only two connection openings could be arranged in the flange of the pump housing, and the arched cooling channels with the several connection openings may be arranged in the flange of the stator housing. It is further preferable to arrange a number of pairs of connection openings in one of the flanges, which corresponds to half the possible angular positions, in which the pump housing and stator housing may be connected to one another. In this manner, one succeeds in the pump housing and the stator housing being able to be connected to one another in every possible angular position, which is set by the arrangement of the fastening elements or fastening bolts in the flanges, and in each case connecting the cooling channels of the pump housing and the stator housing to one another in these positions via connection openings in the two oppositely lying flanges. It is sufficient to provide a number of pairings of connection openings, which corresponds to half the possible angular positions, since it is also possible to apply the pump housing and stator housing onto one another rotated by 180° with respect to the longitudinal axis of the stator housing, i.e. the rotation axis of the rotor. Then, the same pairing of connection openings is thereby used.

According to a particular preferred embodiment of the present invention, a temperature-controlled valve is arranged in at least one of the cooling channels, preferably in the cooling channel of the stator housing and this may, for example, be controlled by a bimetallic strip. Thereby, the valve is preferably designed such that it opens the cooling channel or widens the cross section of the cooling channel on heating, and closes the cooling channel or narrows the cross section on cooling. In this manner, the fluid passage through the cooling channel may be controlled with a closed loop in dependence on the temperature.

BRIEF DESCRIPTION OF THE SEVERAL VIEWS OF THE DRAWINGS

The foregoing summary, as well as the following detailed description of the present invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. There are shown in the drawings.

DETAILED DESCRIPTION OF THE INVENTION

Figure 1:
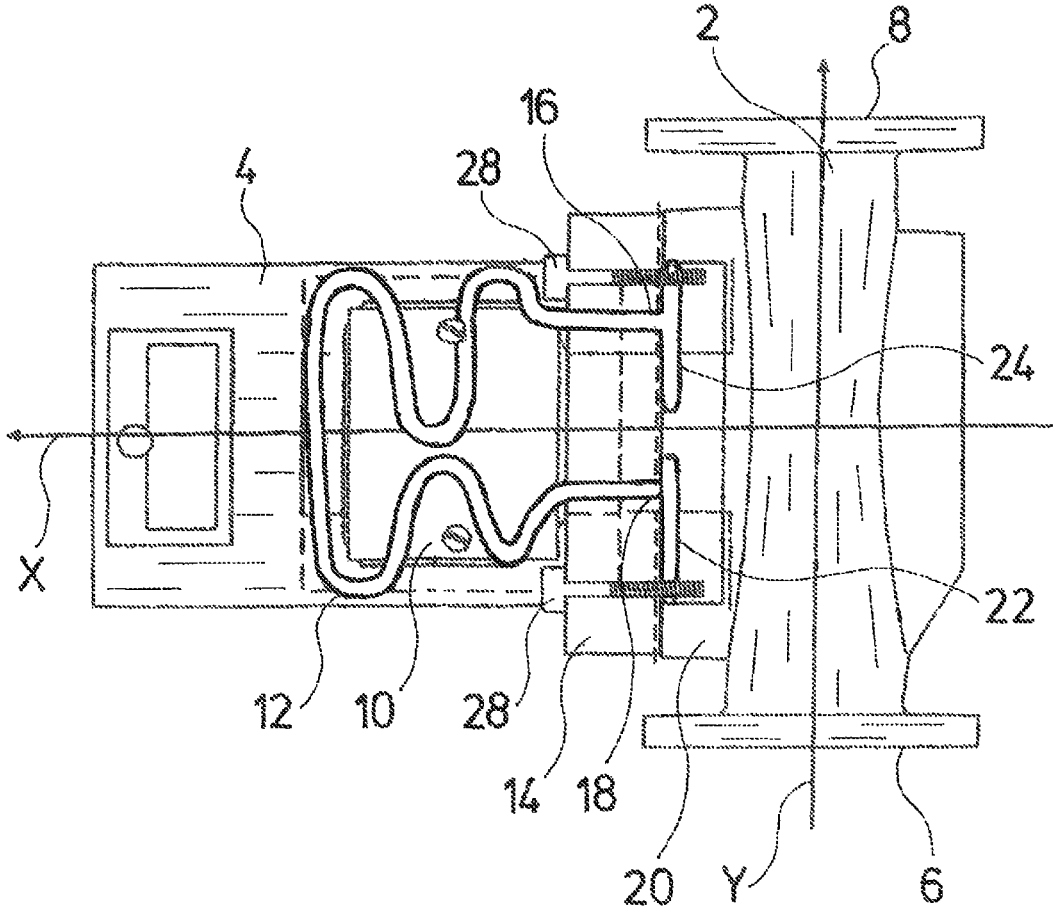
FIG. 1 is a schematic view of an entire pump assembly in accordance with a preferred embodiment of the present invention.

Certain terminology is used in the following description for convenience only and is not limiting. Unless specifically set forth herein, the terms "a," "an" and "the" are not limited to one element, but instead should be read as meaning "at least one." The terminology includes the words noted above, derivatives thereof and words of similar import.

Referring to the drawings in detail, wherein like numerals indicate like elements throughout the several views, the pump assembly according to a preferred embodiment of the present invention, which is shown in the figures by way of examples, preferably includes a pump housing 2 and a stator housing 4 which is flanged thereto. An electric motor which rotatingly drives an impeller arranged in the pump housing 2, is arranged in the stator housing 4. The rotation axis X thereby corresponds to a longitudinal axis of the stator housing 4. A fluid to be delivered flows in the direction Y through the pump housing 2 from a fluid entry 6 to a fluid exit 8 of the pump housing 2. The stator housing 4 preferably includes an assembly plate 10 for electronic components to be cooled, for example an attached terminal box. The assembly surface or assembly space 10 is in heat-conducting connection with the stator housing 4, and electronic components are brought directly or indirectly into contact with this assembly plate 10, in a heat-conducting manner, so that heat may be transmitted from the electrical or electronic components onto this plate and above this onto the stator housing 4.

Moreover, a cooling channel 12, which is shown schematically in the figures, is formed in the inside of a wall of the stator housing 4. This for example is enclosed into the wall of the stator housing or is molded out in this wall on casting. The cooling channel 12 runs out in the flange 14 of the stator housing 4 into two connection openings 16, 18. Oppositely lying connection openings are formed in the flange 20 of the pump housing 2, which lies opposite the flange 14, and these connection openings are connected to two cooling channels 22, 24. Thereby, the cooling channel 22 leads to the fluid entry 6, and the cooling channel 24 to the cooling channel 8. The cooling channel 24 thus serves for the fluid supply to the cooling channel 12, and the cooling channel 22 serves for the fluid discharge from the cooling channel 12, since a greater fluid pressure prevails at the fluid exit of the pump housing 2 than at the fluid entry. Thus the fluid to be delivered flows as a cooling fluid through the cooling channel 12. The cooling channels 22, 24 are also preferably formed in the wall of the pump housing 2, for example cast in or molded out by casting.

Figure 2:
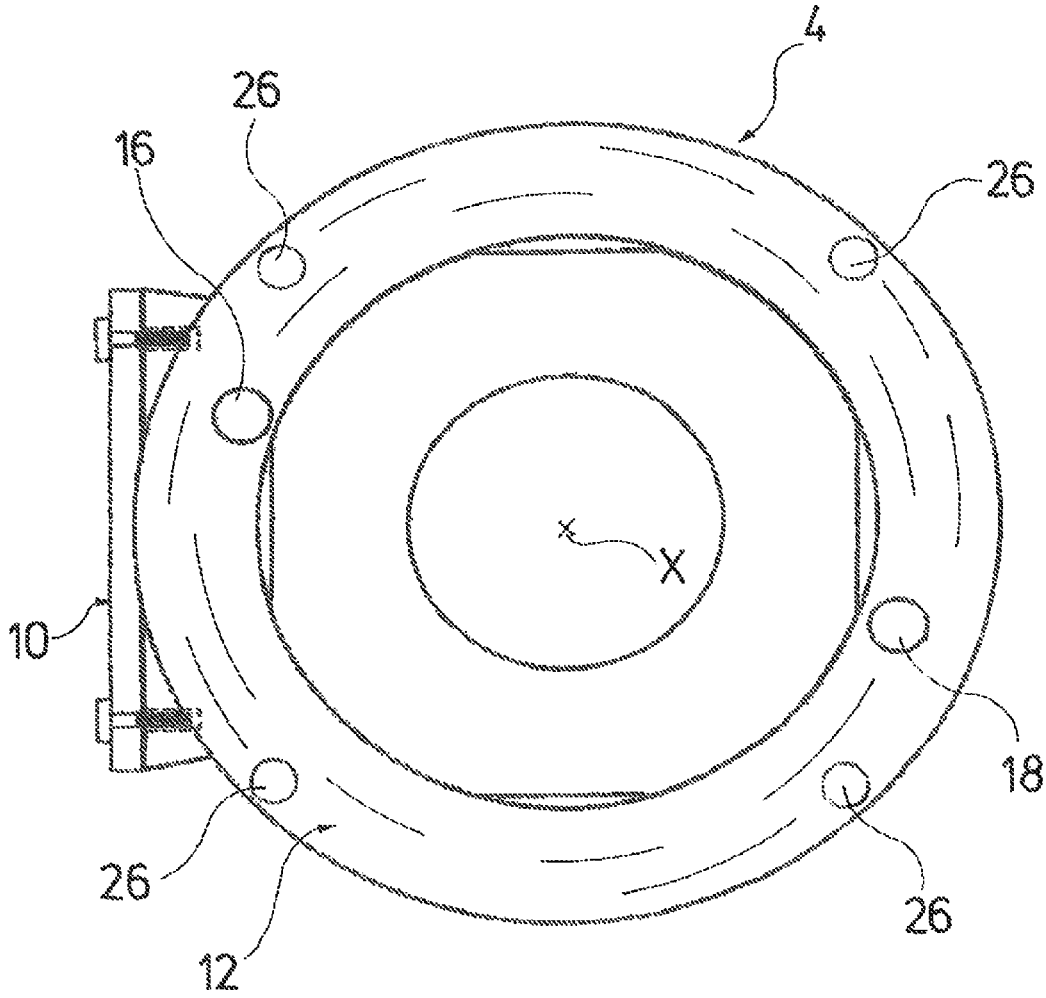
FIG. 2 is a plan view of a flange of a stator housing in accordance with a preferred embodiment of the present invention.

FIG. 2 shows a plan view of the flange 14 of the stator housing 4. One may see that the connection openings 16, 18 of the cooling channel 12 run out into the bearing surface of the flange 14 and are situated in the flange 14 lying diametrically opposite with respect to the longitudinal axis X. Moreover, four fastening holes 26 which are uniformly distributed over the periphery are formed in the flange 14, through which fastening bolts 28 (see FIG. 1) may extend for fastening on the flange 20 of the pump housing. This means that the fastening holes 26 and the fastening bolts 28 are arranged distributed in the flange 14 distanced in each case by 90° with respect to the longitudinal axis X.

Figure 3:
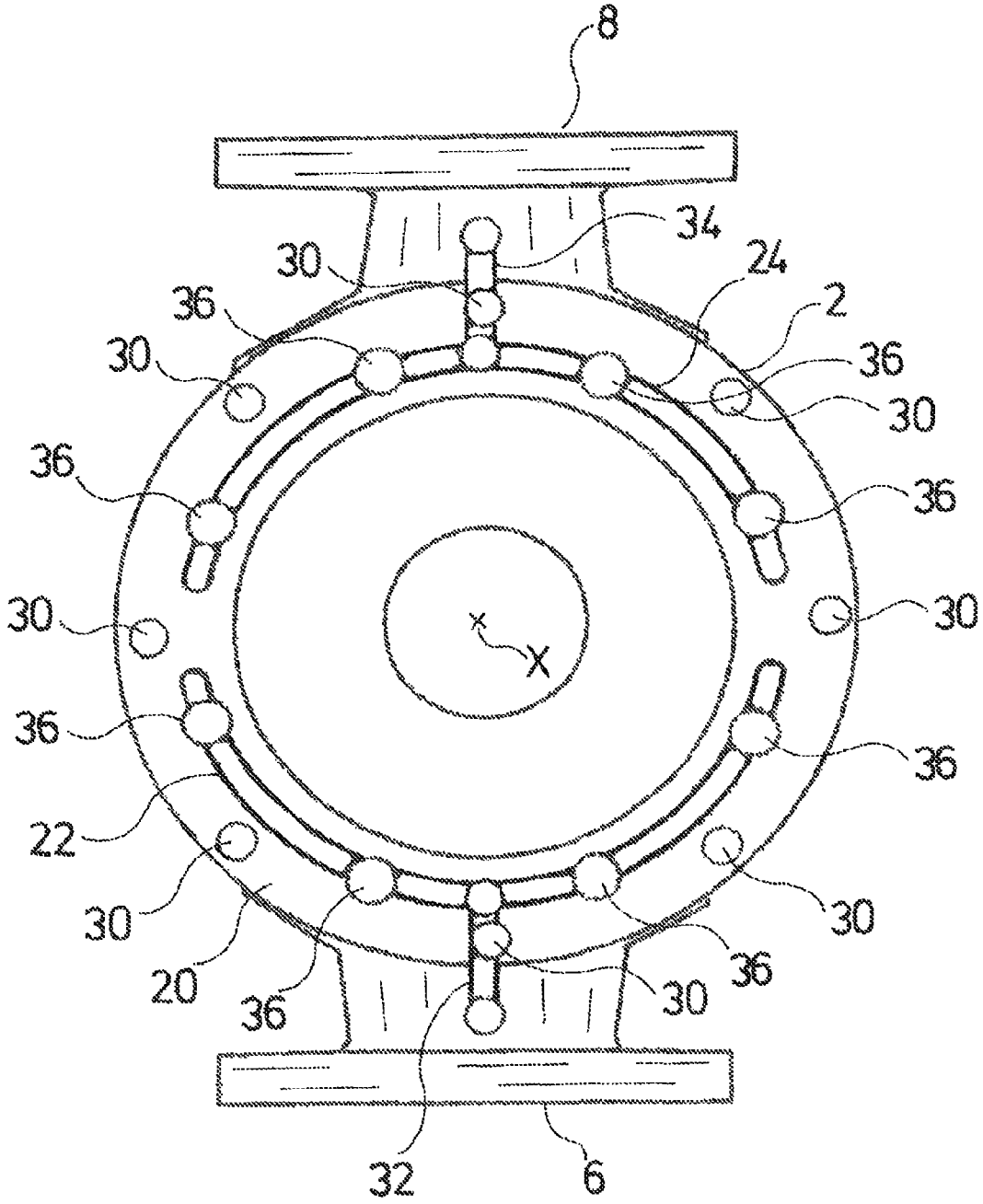
FIG. 3 is a plan view of a flange of the pump housing in accordance with a preferred embodiment of the present invention.

FIG. 3 shows a plan view of the flange 20 of the pump housing 2. In total, eight fastening holes 30 are formed in the flange 20, which are provided with an inner thread, into which the fastening bolts 28 are screwed with their thread. The eight fastening holes 30 are situated on the same radius with respect to the longitudinal axis X, as the fastening holes 26 in the flange 14. The individual fastening holes 30 are in each case distanced by an angle of 45° to one another with respect to the longitudinal axis X. If the flange 14 and the flange 20 are applied onto one another on fastening the stator housing 4 with the pump housing 2, the four fastening holes 26 in each case lie opposite four fastening holes 30. The other four fastening holes 30 remain unused. The number of the fastening holes 30 permits the stator housing 4 to be applied onto the pump housing 2 in 45° steps at different angular positions about the longitudinal axis X.

The cooling channels 22, 24 in the pump housing 2 preferably extend as arch-like channels essentially in each case over 180° of the periphery of the flange 2 within the flange. The cooling channel 22 is connected to the fluid entry 6, and the cooling channel 24 is connected to the fluid exit 8, via the connecting cooling channels 32 and 34. The cooling channels 32, 34, as with the cooling channels 22, 24, are preferably formed in the inside of the pump housing 2, preferably molded out or cast in when casting. In each case, four connection openings 36 are formed in the cooling channel 22 and the cooling channel 24, via which the cooling channels 22, 24 are open towards the end-side or bearing surface of the flange 20. The connection openings 36 with respect to the longitudinal axis X lie on the same radius as the connection opening 16 in the flange 14. Thereby, the connection openings 36 are arranged uniformly distributed over the periphery of the flange 20 each case at an angle of 45° with respect to the longitudinal axis X. This means that there are just as many connection openings 36 as fastening holes 30. The connection openings 36 are arranged offset by an angle of 22.5° relative to the fastening holes 30, so that the connection opening 36 is situated in each case between two fastening holes 30.

Accordingly, the connection openings 16 in the flange 14 are distanced by an angle of 22.5° to the closest fastening holes 26. If then, the flange 14 is applied onto the flange 20, and when in each case one fastening hole 26 is brought to overlap a fastening hole 30, it is ensured that the connection openings 16, 18 in each case lie opposite a connection opening 36. Thereby, then in each case one of the connection openings 16. 18 lies opposite a connection opening 36 in the cooling channel 24, and the other connection opening of the connection openings 16 and 18 lies opposite a connection opening 36 in the cooling channel 24. In this manner, one ensures that the connection openings 16. 18 always lie flush opposite in each case one connection opening 36 in each of the possible angular positions, in which the two flanges 14, 20 may be connected to one another, wherein it is ensured that the connection openings 16 and 18 in each case are flush with a connection opening in another of the two cooling channels 22, 24. In this manner, on assembly of the pump housing 2 and stator housing 4, it is ensured independently of the applied angular position, that a flow path is ensured from the fluid exit 8 via the flow channel 34, the adjacent flow channel 24, one of the connection openings 36 and via one of the connection openings 16, 18 into the cooling channel 12 and back via the in each case other connection opening of the connection openings 16, 18, into a connection opening 36 of the cooling channel 22 and from there via the cooling channel 32 into the fluid entry of the pump housing 2. This means that the pump assembly is very simple to assembly, without having to take particular care with regard to the connection of the cooling channels.

Figure 4:
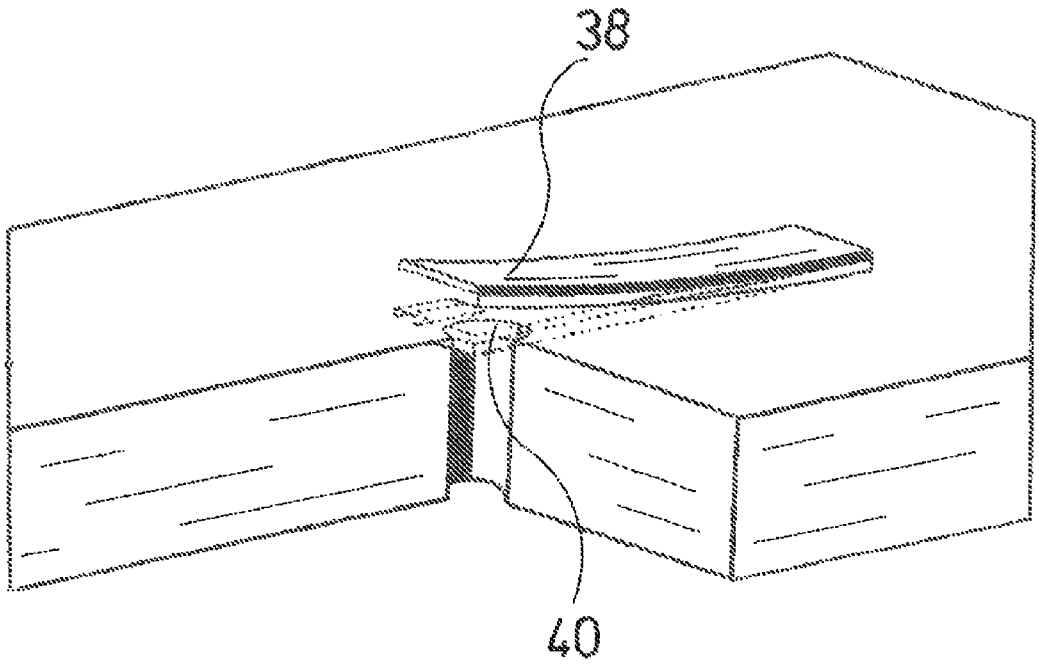
FIG. 4 is schematic view of a valve in a cooling channel in accordance with a preferred embodiment of the present invention.

Additionally, a seal is preferably arranged between the two flanges 14, 20 which seals the flow paths between the connection openings 16, 18 on the one side, and the connection openings 36 on the other side, to the outside. Simultaneously, such a seal ensures that the inside of the pump housing 2 is sealed on the flange, and the connection openings 36 which are not used, are sealingly closed. FIG. 4 schematically shows the construction of a valve, as may be arranged in one of the cooling channels. The cooling channel 40 preferably includes an opening which is covered by a valve element in the form of a bimetallic strip 38. The bimetallic strip 38 is designed such that it approaches the opening 40 on heating, and closes this, as is shown in a dashed manner in FIG. 4. On cooling, the bimetal strip 38 bends and releases the opening 40. In this manner, the flow passage may be opened on heating, and closed on cooling. Such a valve element may be arranged at a suitable location on one of the cooling channels described above.

Although it has been described above by way of FIG. 1-3, that the arched cooling channels 22, 24 are arranged with the associated connection openings 36 in the flange 20 of the pump housing 2, it is to be understood that a converse arrangement of the flanges 14, 20 would also be possible, i.e., that the design of the flange 20 in the stator housing, and the design of the flange 14 with the connection openings 16 and 18 in the flange of the pump housing 2 is envisaged.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as defined by the appended claims.

We claim:

1. A pump assembly comprising a pump housing (2) having a pump having a fluid entry (6) and a fluid exit (8) for a fluid to be delivered, and a stator housing (4) having a motor connected to the pump housing (2), at least one cooling channel (12) being formed in a wall of the stator housing (4) and being connected to cooling channels (22, 24) in the pump housing (2), which are in connection with the fluid entry (6) and the fluid exit (8), so that the fluid flows through the at least one cooling channel (12) on account of a pressure difference between the fluid entry (6) and the fluid exit (8), wherein one of the stator housing (4) and the pump housing (2) includes a first flange (14) and one of the stator housing (4) and the pump housing (2) includes a second flange (20), via which the pump housing (2) and the stator housing are connected to one another, wherein the cooling channels (22, 24) of the pump housing (2) and the at least one cooling channel (12) of the stator housing (4) in each case run out in connection openings (16, 18, 36) in the associated flange (14, 20), and the connection openings (16, 18, 36) in the two flanges (14, 20) lie opposite one another in a manner such that the cooling channels (12, 22, 24) of the stator housing (4) and the pump housing (2) are connected to one another, wherein at least two of the connection openings (36) are provided in one of the first and the second flange (14, 20), which are connected to a same end of an adjacent cooling channel (22, 24), and are arranged in the flange (20) at different angular positions, in a manner such that the stator housing (4) is connectable to the pump housing (2) in at least two different angular positions, in which in each case at least one of the connection openings (16, 18, 36) of the first and of the second flange lie opposite one another.

2. The pump assembly according to claim 1, wherein at least one of the cooling channels (22, 24), extending in an arched manner in a peripheral direction of the flange (20), is formed in one of the two flanges (20), and within the at least one of the cooling channels (22, 24), several connection openings (36), distanced to one another in the peripheral direction, are formed.

3. The pump assembly according to claim 2, wherein the cooling channels (22, 24) which in each case extend in an arched manner essentially along an angle of 180° in the peripheral direction of the flange (20), are formed in one of the two flanges (20), of which one serves for the fluid supply and the other for the fluid discharge, and in which in each case several of the connection openings (36) which are distanced to one another in the peripheral direction of the flange are formed.

4. The pump assembly according to claim 2, wherein at least two of the connection openings (36) which are distanced to one another, are distanced to one another in the peripheral direction of the flange (20) by an angle, which corresponds to an angle between two fastening bolts (30) for the connection of the two flanges (14, 20).

5. The pump assembly according to claim 2, wherein at least one pair of the connection openings (16, 18, 36) is formed in each flange (14, 20), of which one serves for the fluid supply and the other for fluid discharge.

6. The pump assembly according to claim 5, wherein two of the connection openings (16, 18, 36) of the at least one pair of the connection openings are distanced to one another in the peripheral direction of the flange (14, 20) by 180°.

7. The pump assembly according to claim 5, wherein a number of pairs of the connection openings (36) are arranged in one of the flanges (20), which corresponds to half the possible angular positions, in which the pump housing (2) and the stator housing (4) are connectable to one another.

8. The pump assembly according to claim 1, wherein a temperature-controlled valve (38) is arranged in at least one of the cooling channels.

* * * * *